US006165685A

United States Patent [19]

Maerz et al.

[11] Patent Number: 6,165,685

[45] Date of Patent: Dec. 26, 2000

[54] THERMALLY RECORDABLE MATERIAL INSENSITIVE TO WHITE LIGHT

[75] Inventors: Karin Maerz, Gross-Gerau; Helmut Haberhauer, Taunusstein; Andreas Elsaesser, Idstein; Hans-Joachim Schlosser, Wiesbaden; Fritz-Feo Grabley, Kelkheim, all of Germany

[73] Assignee: Agfa-Gevaert N.V., Mortsel, Belgium

[21] Appl. No.: 09/149,044

[22] Filed: Sep. 8, 1998

[30] Foreign Application Priority Data

Sep. 8, 1997 [DE] Germany ..... 197 39 299

[51] Int. Cl.[7] ..... G03C 1/76

[52] U.S. Cl. ..... 430/273.1; 430/278.1; 430/503

[58] Field of Search ..... 430/273.1, 278.1, 430/156, 512, 503, 270.1

[56] References Cited

U.S. PATENT DOCUMENTS

| | | | |
|---|---|---|---|
| 3,458,311 | 7/1969 | Alles . | |
| 5,273,862 | 12/1993 | Zertani et al. . | |
| 5,340,699 | 8/1994 | Haley et al. . | |
| 5,663,037 | 9/1997 | Haley et al. . | |
| 5,879,861 | 3/1999 | Van Damme et al. | 430/302 |
| 5,912,105 | 6/1999 | Haberhauer et al. | 430/273.1 |
| 5,922,502 | 7/1999 | Van Damme et al. | 430/162 |
| 6,022,667 | 2/2000 | Vermeersch et al. | 430/271.1 |

FOREIGN PATENT DOCUMENTS

| | | |
|---|---|---|
| 0 354 475 | 2/1990 | European Pat. Off. . |
| 0 354 475A | 2/1990 | European Pat. Off. . |
| 0 562 952 | 9/1993 | European Pat. Off. . |
| 0 573 805 | 12/1993 | European Pat. Off. . |
| 0 580 393 | 1/1994 | European Pat. Off. . |
| 0 625 728 | 11/1994 | European Pat. Off. . |
| 0 652 483 | 5/1995 | European Pat. Off. . |
| 0 672 954 | 9/1995 | European Pat. Off. . |
| 0 683 435 | 11/1995 | European Pat. Off. . |
| 0 704 764 | 4/1996 | European Pat. Off. . |
| 0 773 112 | 5/1997 | European Pat. Off. . |
| 0 867 278A | 9/1998 | European Pat. Off. . |
| 1154749 | 6/1969 | United Kingdom . |
| 25 12 038 | 10/1977 | United Kingdom . |
| 90/12342 | 10/1990 | WIPO . |
| WO 96/20429 | 7/1996 | WIPO . |

*Primary Examiner*—Janet Baxter
*Assistant Examiner*—Barbara Gilliam
*Attorney, Agent, or Firm*—Foley & Lardner

[57] ABSTRACT

The invention relates to a recording material having a substrate and a radiation-sensitive, water-insoluble layer which contains a component absorbing IR radiation and which, after the action of infrared radiation, becomes soluble or at least swellable in an aqueous alkaline developer. A top layer which is opaque to white light but transparent to radiation in the IR range and can be removed with water or an aqueous solution is present on the radiation-sensitive layer. The recording material is substantially insensitive to daylight. By imagewise exposure to IR radiation and subsequent development with an aqueous alkaline developer, it is possible to produce a printing plate for offset printing from the recording material. If the top layer is washed off beforehand, the recording can also be carried out using conventional UV radiation.

17 Claims, No Drawings

THERMALLY RECORDABLE MATERIAL INSENSITIVE TO WHITE LIGHT

BACKGROUND OF THE INVENTION

1. Field of the Invention

The invention relates to a recording material having a substrate and a radiation-sensitive layer which contains a component absorbing IR radiation and which, after the action of infrared radiation, becomes soluble or at least swellable in an aqueous alkaline developer. The material is insensitive to white light. It is particularly suitable for the production of printing plates for offset printing.

2. Description of the Related Art

Recording materials whose radiation-sensitive layer is sensitive in the ultraviolet and/or visible range are conventionally used for the production of printing plates for offset printing. The layer is recorded on by means of radiation of appropriate wavelengths through a photographic negative and is then developed. Recent processes can be accomplished without such photographic negatives. The recording is then effected by means of laser beams from digitally controlled lasers, known as "computer-to-plate" processes. However, lasers which emit radiation in the range of visible light are relatively expensive and also require special recording materials. See, for example, EP-A 0 573 805 (=CA-A 2 097 038) and EP-A 0 704 764.

On the other hand, infrared lasers, in particular infrared laser diodes, are substantially more economical. However, recording materials which are sensitized in the IR range, i.e., in the range from about 700 to 1100 nm, are required for this purpose. Many of these IR-sensitized materials have the further advantage that they are not sensitive in the ultraviolet and visible range (referred to below as UV/VIS) and consequently can be processed in daylight or normal white artificial light. Examples of these are described in DE-A 25 12 038 (=GB-A 1 489 308), WO 90/12342 and EP-A 0 562 952, 0 580 393, and 0 773 112.

Materials which are sensitized both in the UV/VIS and in the IR range are also known (EP-A 0 625 728 and 0 672 954, WO 96/20429). They cannot of course be processed in normal illumination.

SUMMARY OF THE INVENTION

There is therefore a desire to provide a recording material which can be sensitized in the UV/VIS as well as the IR range but can nevertheless be recorded on in normal ambient light by IR radiation. The object has been achieved by the present invention of a recording material including a top layer which is virtually opaque to UV/VIS radiation, such as white light, but transparent to IR radiation and can be removed with water or an aqueous solution.

It is also a object of the invention to provide a process for producing a printing plate by use of such recording material.

In accordance with these objectives, there has been provided a recording material comprising in the following order: a substrate, a radiation-sensitive water-insoluble layer comprising a component that absorbs infrared radiation and upon absorption of the infrared radiation becomes soluble or swellable in an aqueous alkaline developer, and a top layer which is opaque to white light but transparent to infrared radiation, and which can be removed with water or with an aqueous solution.

In accordance with these objections, there is also proposed a process for the production of a printing plate for offset printing, comprising exposing a recording material as discussed above imagewise to infrared radiation and then developing the exposed material in an aqueous alkaline developer at a temperature of from 20 to 40° C.

Further objects, features, and advantages of the invention will become apparent from the detailed description that follows.

DETAILED DESCRIPTION OF PREFERRED EMBODIMENTS

The present invention provides a recording material having a substrate and a radiation-sensitive, water-insoluble layer which contains a component absorbing IR radiation and which, after the action of infrared radiation, becomes soluble or at least swellable in an aqueous alkaline developer. In the recording material, a top layer which is opaque to white light but transparent to radiation in the IR range and can be removed with water or an aqueous solution is present on the radiation-sensitive layer.

By means of the top layer, the scratch sensitivity of the radiation-sensitive layer is also greatly reduced. Moreover, the top layer prevents components of the radiation-sensitive layer which may have been removed under the action of the IR laser beams from being deposited in the exposure unit. Particularly in the case of inner-drum exposure units, soiling of the laser optical system can give rise to problems. "White light" means daylight or light from incandescent lamps, fluorescent tubes and other lighting means which emit normal white light. "Radiation in the IR range" is to be understood here—as generally customary—as meaning radiation having a wavelength of 700 to 1100 nm.

A preferred recording material is one which is sufficiently sensitized for imagewise differentiation not only in the IR range but also in the UV/VIS range so that, after removal of the top layer, conventional UV exposure is also possible (which can be carried out not in a white light environment but only in red or yellow safety light).

Any top layer which is opaque to white light, but transparent to IR radiation, removable with water or an aqueous solution can be used. The top layer generally contains at least one water-soluble, organic, polymeric binder and at least one component which absorbs radiation in the UV/VIS range. This component preferably has an absorption maximum in the range from 300 to 500 nm, especially in the range from 350 to 450 nm.

Any desired absorbing component can be used. Particularly suitable absorbing components are dyes and pigments. The term "dyes" is intended to be understood as meaning all compounds which absorb in the stated range even if they are only slightly colored or not colored at all in the visible range. Polyhydroxybenzophenones (e.g., 2,4-dihydroxybenzophenone), Sudan Yellow (Color Index No. 30=C.I. 30), ®Remazolgelb RTL (Reactive Yellow 24), ®Astrazongelb 3G (C.I. 48055), ®Astrazonorange 3R (Basic Orange 22), Fluorescent Yellow T (Acid Yellow 245), ®Blankophor PSG (Fluorescent Brightener 113) and Tartrazine X90 (C.I. 19140) are mentioned in particular.

Water-insoluble UV/VIS absorbers may likewise be used but must generally be dispersed beforehand with a water-soluble binder. The binder used for dispersing is preferably identical to the other binder in the top layer. The amount of UV/VIS absorber is in general from 5 to 50% by weight, preferably from 20 to 30% by weight, based in each case on the total weight of the nonvolatile components of the top layer. In general, the amount should be at least sufficiently high to achieve an optical density of at least 2 (measured against white paper as reference material). Preferably, the optical density of the top layer is from 2.2 to 2.5.

Any desired binders can be used in the top layer. Particularly suitable binders for the top layer include polyvinyl alcohols, polyvinylpyrrolidones, partially hydrolyzed polyvinyl acetates which may additionally contain vinyl ether or vinyl acetate units, gelatin, carbohydrates, cellulose derivatives (e.g., hydroxyethyl cellulose), gum arabic, polyethylene oxides, polyvinyl ethers, poly(meth)acrylates and corresponding copolymers. Polyvinyl alcohols are particularly preferred. In addition, the top layer may contain minor amounts of surfactants, inert particles, and/or plasticizers. The thickness of the top layer is in general up to 5 $\mu$m, preferably from 0.5 to 2.5 $\mu$m. It should be chosen so that the IR sensitive layer underneath can still be recorded on without problems.

Top layers without UV/VIS absorbers are known and are described, for example, in U.S. Pat. No. 3,458,311 and EP-A 352 630 (U.S. Pat. No. 5,273,862). They serve in particular for protecting, e.g., from the action of atmospheric oxygen, layers underneath which are capable of undergoing free radical polymerization, since oxygen inhibits the polymerization. At the same time, the top layer protects from moisture, leading to a longer shelf-life of the recording materials. EP-A-0 354 475 also discloses a top layer which protects the photopolymerizable layer underneath from oxygen and at the same time acts as an optical filter. For this purpose, said layer contains a dye which absorbs light with a wavelength of from 300 to 700 nm but has an absorption gap within this range. The gap is chosen so that it corresponds to the emission range of the light source used for recording. The known top layer is then removed together with the unexposed parts of the polymerizable layer by the developer solution.

The composition of the IR sensitive layer of the present invention is not particularly critical. However, it should be at least sufficiently water-insoluble that it is virtually not attacked during removal of the top layer. A layer which is IR- and UV/VIS-sensitive is preferred. A particularly suitable layer contains an IR-absorbent component, polymeric binder, and a UV-sensitive component.

Any desired IR absorbing component can be used. Common black pigments as described, for example, in WO 96/20429, hereby incorporated by reference, are particularly suitable as IR absorbing components since they absorb over a wide IR wavelength range. When they are used, both Nd-YAG lasers which operate at a wavelength of 1064 nm and economical laser diodes which operate at 830 nm may therefore be employed. Common black pigments having a mean primary particle diameter of less than 80 nm are preferred. According to DIN 53206, the term "primary particles" means very small particles (individual particles) of which pulverulent substances are composed. They are detectable as individual entities under the electron microscope. Suitable carbon blacks are flame, furnace or channel blacks. The surface area determined by the Brunauer, Emmett and Teller method ("BET surface area") is in general more than 10 $m^2/g$. Particularly suitable carbon blacks are oxidized on their surface, with the result that acidic units form.

The carbon black incorporated into the radiation-sensitive layer can be dispersed in binders if desired. Dispersing of the carbon black particles with binders can be carried out in generally known apparatuses. For example, the mixture of pigment and binder can be predispersed in a dissolver and then finally dispersed in a ball mill. The organic solvents used may differ from the actual coating solvents but are preferably identical. Any desired solvents can be used. Particularly suitable solvents are propylene glycol monomethyl ether (PGME), propylene glycol monomethyl ether acetate (PGMEA), ethyl lactate, butanone, gamma-butyrolactone, tetrahydrofuran, and mixtures thereof.

The stability of the dispersions thus produced can in some cases be further improved by adding surfactants and/or thickeners. Surfactants and thickeners soluble in aqueous alkaline solutions are particularly preferred. Instead of or additionally to the carbon black pigments, other heat-absorbing substances, such as squarylium, cyanine, merocyanine, or pyrylium compounds, may also be present in the layer sensitive to IR radiation. The amount of the IR-absorbing component is in general from 0.5 to 30% by weight, preferably from 2 to 15% by weight, based in each case on the total weight of the nonvolatile components of the layer.

The layer sensitive to IR radiation furthermore generally contains a polymeric binder. Any desired binder can be used. Particularly suitable are binders having acidic groups whose $pK_a$ is less than 13. These include, for example, polycondensates as obtained on the reaction of phenols or sulfamoyl- or carbamoyl-substituted aromatics with aldehydes or ketones. In this context "phenols" may also be substituted phenols, such as resorcinol, cresol, xylenol or trimethylphenol, in addition to phenol. The aldehyde is preferably formaldehyde. Reaction products of diisocyanates with diols or diamines are also suitable, provided that they have acidic units. Polymers having units of vinylaromatics, N-aryl(meth)acrylamides or aryl (meth) acrylates may furthermore be used, these units each also generally having one or more carboxyl groups, phenolic hydroxyl groups, sulfamoyl groups or carbamoyl groups. Specific examples include polymers having units of 2-hydroxyphenyl (meth)acrylate, of N-(4-hydroxyphenyl)-(meth)acrylamide, of N-(4-sulfamoylphenyl)(meth) acrylamide, of N-(4-hydroxy-3,5-dimethylbenzyl)(meth) acrylamide, or 4-hydroxystyrene or of hydroxyphenylmaleimide. The polymers may additionally contain units of other monomers which have no acidic groups. These include, for example, units of olefins or vinylaromatics, methyl (meth)acrylate, phenyl (meth)acrylate, benzyl (meth)-acrylate, methacrylamide or, acrylonitrile. The term "(meth)acrylate" represents "acrylate and/or methacrylate". The same applies to "(meth)acrylamide". The amount of the binder is in general from 2 to 98% by weight, preferably from 50 to 85% by weight, based in each case on the total weight of the nonvolatile components of the radiation-sensitive layer.

The UV/VIS-sensitive component optionally present in the radiation-sensitive layer may be selected from any such compound, and is preferably an onium salt. A combination of an acid-forming compound and a compound cleavable by the acid produced thermally or photochemically from this compound is also particularly suitable. Preferred acid-cleavable compounds are polymers having hydrophilic, acidic groups (in particular carboxyl and phenolic hydroxyl groups), some or all of which are masked by hydrophobic, acid-labile groups. After the acid-catalyzed elimination of the hydrophobic groups, the solubility of the polymer in aqueous alkaline developers is greatly increased again. The hydrophobic acid-labile groups are, for example, tert-alkoxycarbonyloxy, benzyloxycarbonyloxy and alkoxyalkyl ester groups of the formula —CO—O—$CR^1R^2$—$OR^3$, in which $R^3$ is a ($C^1$–$C^{18}$)alkyl group and $R^1$ and $R^2$ independently of one another are a hydrogen atom or a ($C^1$–$C^{18}$) alkyl group, with the proviso that at least one of the radicals $R^1$ and $R^2$ is a hydrogen atom. Tert-butoxycarbonyloxy and tetrahydropyranyloxycarbonyl groups are particularly preferred. Polyhydroxy-styrenes, some or all of whose hydroxyl groups have been converted into acid-cleavable groups, such as tert-butoxycarbonyloxy groups, are particularly suitable.

Such polymers having acid-cleavable groups are described, for example, in EP-A 0 652 483 and 0 683 435 (=U.S. Pat. No. 5,654,121). Depending on the type of hydrophobic, acid-labile groups, gaseous decomposition products may form when they are eliminated. For example, $CO_2$ and isobutene are formed on cleavage of the tert-butoxycarbonyloxy group.

Particularly suitable acid formers are diazonium, phosphonium, sulfonium and iodonium salts of strong acids. The opposite ion in the salts is preferably hexafluorophosphate, hexafluoroantimonate, or perfluoroalkanesulfonate.

Particularly preferred components sensitive to UV/VIS radiation are diazo compounds, especially esters or amides of 1,2-naphthoquinone-2-diazide-4- or -5-sulfonic acid. These include in particular esters of 1,2-naphthoquinone-2-diazide-4- or -5-sulfonic acid and a compound having at least one phenolic hydroxyl group, preferably at least 3 phenolic hydroxyl groups. Very particularly preferred compounds are those having 3 to 6 phenolic hydroxyl groups, such as 2,3,4-trihydroxybenzophenone, 2,3,4-trihydroxy-3'-methyl-, -propyl- or -isopropylbenzophenone, 2,3,4,4'-tetrahydroxybenzophenone, 2,3,4,2',4'-pentahydroxybenzophenone, 2,3,4,2',3',4'-hexahydroxybenzophenone and 5,5'-diacyl-2,3,4,2',3',4'-hexahydroxydiphenylmethane. Other hydroxy components which may be used for the esterification are condensates of pyrogallol and aldehydes or ketones and condensates of alkylated phenols and formaldehyde. The layer may also contain a mixture of a plurality of radiation-sensitive components. The amount of UV/VIS-sensitive component is in general from 1 to 50% by weight, preferably from 5 to 30% by weight, based in each case on the total weight of the nonvolatile components of the radiation-sensitive layer.

The radiation-sensitive layer may also contain minor or customary amounts of further additives generally customary in such layers. These include indicator dyes (for example, dialkylaminoazobenzenes), photochemical acid formers (for example, trifluoromethanesulfonates or hexafluorophosphates of diazodiphenylamines), surfactants (preferably fluorine-containing surfactants or silicon surfactants), polyalkylene oxides for controlling the acidity of the acidic groups, and/or low molecular weight compounds having acidic units for increasing the rate of development.

The substrate in the recording material according to the invention can be any desired substrate, but is preferably an aluminum foil or sheet. A laminate comprising an aluminum foil and a polyester film is also suitable. The aluminum surface is preferably mechanically and/or electrochemically roughened and anodically oxidized. It may furthermore have been hydrophilized with a suitable, generally polymeric compound. Compounds having phosphonic acid or phosphonate units, in particular polyvinylphosphonic acid, are suitable for this purpose. The actual roughening may further be preceded by degreasing, and if desired also further mechanical and/or chemical roughening.

The recording material may be formed in any desired manner. For example, a solution of the described mixture sensitive to IR radiation is applied to the substrate and is dried. Suitable coating solvents are the abovementioned, generally customary organic solvents, which can also be used for dispersing the carbon black. After the drying, the layer sensitive to IR radiation generally has a layer weight of from 0.5 to 5.0 g/m$^2$, preferably from 1.0 to 3.0 g/m$^2$, corresponding to about 0.5 to 5.0 $\mu$m, preferably about 1.0 to 3.0 $\mu$m. The top layer is then applied from an aqueous solution or dispersion which, if desired, may also contain small amounts of organic solvents, i.e., less than 5% by weight, based on the total weight of the coating solvents for the top layer.

The present invention also relates to a process for the production of a printing plate for offset printing from the recording material according to the invention. Any desired exposing and developing can be used, but in a preferred process, the recording material is first exposed imagewise to infrared radiation and then developed in a conventional aqueous alkaline developer at a temperature of from 20 to 40° C. During the development, the water-soluble top layer is also removed. In a further embodiment of the process according to the invention, the top layer is removed with water before or after recording by means of IR radiation, but before the development.

In particular, outer-drum or inner-drum exposure units with laser diodes (emission maximum 830 nm) or Nd-YAG lasers (emission maximum 1064 nm) are suitable for recording. The developer generally has a ratio of $SiO_2$ to alkali metal oxide of at least 1. This ensures that the aluminum oxide layer of the substrate is not damaged. Preferred alkali metal oxides are $Na_2O$ and $K_2O$ and mixtures thereof In addition to alkali metal silicates, the developer may contain further components, such as buffer substances, complexing agents, antifoams, organic solvents in small amounts, corrosion inhibitors, dyes, surfactants, and/or hydrotropic agents. The development is generally carried out in mechanical processing units.

To increase the resistance of the produced printing plate and hence to increase the possible length of the print run, set plate can be briefly exposed to elevated temperatures ("baking"). Consequently, the resistance of the printing plate to developers, correction compositions and UV-curable printing inks also increases. Such a thermal aftertreatment is described, for example, in DE-A 14 47 963 (=GB-A 1 154 749), both hereby incorporated by reference.

The following examples are intended to illustrate the subject of the invention without imposing any restriction thereon. Percentages therein are percentages by weight and ratios are weight ratios, unless stated otherwise. "Pbw" represents part(s) by weight.

EXAMPLE 1 (COMPARATIVE EXAMPLE)

UV/VIS- and IR-sensitized recording material (UV sensitization with diazo compound) without top layer:

| A coating dispersion was prepared from | |
|---|---|
| 20.0 pbw | of an ester of 1 mol of 2,3,4-trihydroxybenzophenone and 1.5 mol of 1,2-naphthoquinone-2-diazide-5-sulfonyl chloride, |
| 20.0 pbw | of carbon black dispersion having the composition stated below, |
| 3.0 pbw | of 2,4-dihydroxybenzophenone, |
| 57.0 pbw | of cresol/xylenol/formaldehyde novalak (® Alnovol SPN 400), 43.5% strength in propylene glycol monomethyl ether acetate), |
| 455.0 pbw | of propylene glycol monomethyl ether (PGME) and |
| 455.0 pbw | of tetrahydrofuran. |

| The carbon black dispersion comprised | |
|---|---|
| 10.0 pbw | of carbon black (®Printex 25) |
| 10.0 pbw | of cresol/xylenol/formaldehyde novolak (®Alnovol SPN 400, 45.3% strength in PGMEA), |
| 28.8 pbw | of PGME and |
| 0.01 pbw | silicone oil. |

The coating solution was applied to an aluminum foil roughened in hydrochloric acid and anodized in sulfuric acid and hydrophilized with polyvinylsulfonic acid. After drying for 2 min at 100° C., the layer thickness was 2 $\mu$m.

Recording was then effected by two different methods:

a) In an outer-drum exposure unit with an IR laser diode strip (emission maximum 830 nm; power of each individual diode: 40 mW, write speed: 1 m/s; beam width: 10 $\mu$m), the recording material was terminally recorded on using a digital half tone copy.

b) In a conventional vacuum printing frame, the recording material was recorded on under a half tone copy with UV radiation from a metal halide-doped mercury vapor lamp with a power of 5 kW (emission range: 350 to 450 nm) at a dose of 700 mJ/cm$^2$.

Development was the same for both imagewise exposed recording materials. It was carried out in a conventional processing unit at a throughput speed of 0.4 m/min at a temperature of 28° C. using an aqueous potassium silicate developer which contained $K_2SiO_3$ (normality: 0.8 mol/l in water) and 0.2% by weight of O,O'-bis-carboxymethylpolyethylene glycol 1000 and 0.4% by weight of perlargonic acid. A solution of from 2 to 98% of a 60 line screen was achieved with both recording materials. The image background was fog-free. It was possible to produce more than a 100,000 satisfactory prints with the offset printing plates thus produced.

To determine the sensitivity to daylight, samples of the recording material were exposed to (UV-containing) daylight for different times before or after the thermal recording but in any case before the development. The energy which acted on the material was determined using a photometer (spectral sensitivity: from 300 to 450 nm). It was about 2 mJ per square metre per minute. When the material was in daylight even for only 1 min, substantial losses in the point range were observed even after development, and after 4 min in daylight the material no longer had any resistance and was attacked by the developer even in the unexposed parts.

EXAMPLE 2 (COMPARATIVE EXAMPLE)

UV/VIS- and IR-sensitized recording material (UV sensitization by combination of acid former and polymer having acid-cleavable groups) without top layer:

A sheet of electrochemically roughened and subsequently anodized aluminum was coated by spin-coating with a dispersion of

| | |
|---|---|
| 6.7 pbw | of poly(4-hydroxystyrene) in which 30% of the hydroxyl groups have been converted into tert-butoxycarbonyloxy groups and 15% into 2,3-dihydroxypropoxy groups (as described in the non prior published DE 197 29 067.1, herein incorporated by reference in its entirety.) |
| 0.5 pbw | of 4-para-toluenemercapto-2,5-diethoxybenzenediazonium hexafluorophosphate, |

-continued

| | |
|---|---|
| 0.01 pbw | of silicone oil as a surface improver, |
| 17.0 pbw | of carbon black dispersion, (as in Example 1), |
| 42.0 pbw | of propylene glycol monomethyl ether and |
| 34.0 pbw | of tetrahydrofuran. |

After drying for 1 min at 100° C., the layer weight was from 1.8 to 2.2 g/m$^2$. The recording material thus prepared was recorded on thermally using an Nd-YAG laser (wavelength: 1064 nm; power: 10 mW). In the exposed parts, parts of the layer had been detached by the gas evolution, leading to soiling of the exposure unit.

The material was then developed for 1 min at 28° C. in a developer comprising

| | |
|---|---|
| 5.5 pbw | of sodium silicate nonahydrate, |
| 3.4 pbw | of trisodium phosphate dodecahydrate, |
| 0.4 pbw | of monosodium phosphate (anhydrous) and |
| 90.7 pbw | of demineralized water. |

EXAMPLE 3

(as for Example 1, but with top layer)

The following dyes or UV absorbers are added in the stated amounts to 100 g portions of a solution of 7 pbw of polyvinyl alcohol (average degree of polymerization $P_w$ about 1000) and 93 pbw of demineralized water:

| Example No. | Additive | C.I. Designation | Amount |
|---|---|---|---|
| 3a | Astrazon Yellow 3G | 48085 | 2,5 |
| 3b | Acid Orange GG | 16230 | 2,5 |
| 3c | ®Vitasyn Tartrazin X90 | 19140 | 3,0 |
| 3d | Fluorescent Yellow T | Acid Yellow 245 | 2,0 |
| 3e | ®Blankophor PSG | Fluorescent Brightener 113 | 0,4 |
| 3f)* | --(no additive) | — | — |

)* = Comparative experiment

The top layers thus obtained were each applied to the recording material from Example 1 and dried for 2 min at 100° C. The weight of the dried top layer was then from about 2 to 3 g/m$^2$. The material thus obtained was then recorded on—as described in Example 1a)—by means of IR radiation. The subsequent development was likewise carried out according to Example 1. The printing plates thus obtained were equivalent to those from Example 1, in all important properties, particularly in the quality and the stability.

To be able to carry out conventional exposure—as described in Example 1 b)—the top layer was washed off beforehand with conventional tap water. The printing plates obtained after development showed virtually no difference to those of Example 1 b).

To determine the sensitivity to daylight, the recording materials provided with a top layer were exposed to UV-containing white light for different times. The materials according to Examples 3a to 3e still showed no loss of resistance even after 6 min. In the case of the samples 3a to 3d, no loss in the point ranges was visible even after exposure to white light for 12 min after development. The recording material according to 3f showed substantial point losses after only 2 min.

EXAMPLE 4

(as for Example 2, but with top layer)

A coating solution according to Example 3c or 3f was applied to the recording material according to Example 2 and was dried. After drying for 2 min at 100° C., the weight of the top layers thus produced was once again from 2 to 3 g/m$^2$. In contrast to Comparative Example 2, no components were removed from the layer during the IR exposure.

EXAMPLE 5

A solution of

| | |
|---|---|
| 5.0 pbw | of polyvinylpyrrolidone (® Luviskol K 30), |
| 10.0 pbw | of a copolymer comprising 70% of vinylpyrrolidone units and 30% of vinyl acetate units, 50% strength in water (® Luviskol VA73 W), |
| 5.0 pbw | of ® Duasyn Säuregelb XX (Acid Yellow 23, C.I. 19140) and |
| 80.0 pbw | of demineralized water |

was applied to a recording material according to Example 2 and was dried for 2 min at 100° C. After the drying, the layer weight was 2.5 g/m$^2$. The recording material was then recorded on thermally as described in Example 1a). The stability to white light under the light conditions stated in Example 1 was at least 15 min.

EXAMPLE 6

(Determination of the scratch sensitivity)

Recording materials according to Example 1 (without top layer) and Example 3c (with top layer) were investigated with regard to their scratch resistance using an Oesterle scar resistance tester (Erichsen scar resistance tester model 435). The magnitude of the force acting on the test disk which produced visible scratches in the image layer after development was measured in each case.

In the case of the material according to Example 1, a force of 1 N was sufficient to cause visible damage in the image parts after development. In the case of the material according to Example 3c, no damage to the layer was detectable in the image parts after development even with application of a force of 20 N, although deformation of the aluminum substrate then occurred.

German Application, 197 39 299.7 filed Sep. 8, 1997 (the priority document of the present application), is hereby incorporated by reference in its entirety.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

We claim:

1. A recording material comprising in the following order:

a substrate, a radiation-sensitive water-insoluble layer comprising a component that absorbs infrared radiation and upon absorption of the infrared radiation becomes soluble or swellable in an aqueous alkaline developer, and a top layer which is opaque to white light but transparent to infrared radiation, and which can be removed with water or with an aqueous solution.

2. A recording material as claimed in claim 1, wherein the radiation-sensitive layer is sensitized for imagewise differentiation in the UV/VIS range.

3. A recording material as claimed in claim 1, wherein the component that absorbs infrared radiation comprises a carbon black pigment.

4. A recording material as claimed in claim 3, wherein the carbon black pigment is dispersed in the radiation-sensitive layer with a binder.

5. A recording material as claimed in claim 1, wherein the amount of the component that absorbs infrared radiation is from 0.5 to 30% by weight, based on the total weight of the nonvolatile components of the radiation-sensitive, water-insoluble layer.

6. A recording material as claimed in claim 1, wherein the top layer contains at least one water-soluble, organic, polymeric binder and at least one component which absorbs radiation in the UV/VIS range.

7. A recording material as claimed in claim 6, wherein the component which absorbs UV/VIS radiation has an absorption maximum in the range from 300 to 500 nm.

8. A recording material as claimed in claim 7, wherein the component which absorbs UV/VIS radiation comprises a dye or a pigment.

9. A recording material as claimed in claim 7, wherein the amount of the component which absorbs UV/VIS radiation is from 5 to 50% by weight, based on the total weight of the nonvolatile components of the top layer.

10. A recording material as claimed in claim 1, wherein the top layer has an optical density of at least 2.0, measured against white paper as reference material.

11. A recording material as claimed in claim 1, wherein the thickness of the top layer is up to 5 $\mu$m.

12. A recording material as claimed in claim 1, wherein the substrate comprise an aluminum foil or sheet, or a laminate comprising an aluminum foil and a polyester film.

13. A recording material as claimed in claim 1, wherein the substrate comprises an aluminum surface mechanically or electrochemically roughened, and anodically oxidized.

14. A process for the production of a printing plate for offset printing, comprising exposing a recording material as claimed in claim 1 imagewise to infrared radiation and then developing the exposed material in an aqueous alkaline developer at a temperature of from 20 to 40° C.

15. A process as claimed in claim 14, wherein infrared lasers are used for the exposing.

16. A process as claimed in claim 14, wherein the top layer is removed with water after the exposing but before the development.

17. A printing plate produced according to the process of claim 14.

* * * * *